United States Patent [19]

Miura et al.

[11] Patent Number: 4,491,121

[45] Date of Patent: Jan. 1, 1985

[54] IGNITION SYSTEM FOR TWO-CYCLE ENGINE

[75] Inventors: Nobuo Miura, Wako; Norihisa Ishii, Sakado, both of Japan

[73] Assignee: Honda Giken Kogyo Kabushiki Kaisha, Tokyo, Japan

[21] Appl. No.: 407,140

[22] Filed: Aug. 11, 1982

[30] Foreign Application Priority Data

Aug. 13, 1981 [JP] Japan ..... 56-120745[U]
Dec. 4, 1981 [JP] Japan ..... 56-180620[U]

[51] Int. Cl.[3] ..... F02P 5/00

[52] U.S. Cl. ..... 123/631; 123/617; 123/599

[58] Field of Search ..... 123/599, 631, 612, 617, 123/630

[56] References Cited

U.S. PATENT DOCUMENTS

| | | | |
|---|---|---|---|
| 3,795,235 | 3/1974 | Donohue et al. | 123/631 |
| 3,861,368 | 1/1975 | Dogadro | 123/631 |
| 3,955,549 | 5/1976 | Burson | 123/631 |
| 4,313,414 | 2/1982 | Planteline | 123/617 |
| 4,365,602 | 12/1982 | Stiller et al. | 123/612 |

FOREIGN PATENT DOCUMENTS

| | | | |
|---|---|---|---|
| 1181492 | 11/1964 | Fed. Rep. of Germany | 123/631 |
| DE-GM6921710 | 11/1969 | Fed. Rep. of Germany . | |

*Primary Examiner*—Parshotam S. Lall
*Attorney, Agent, or Firm*—Birch, Stewart, Kolasch & Birch

[57] ABSTRACT

An ignition system for a two-cycle engine which comprises a rotational body rotatable in synchronism with the crank shaft of the engine and having thereon a detectable portion extending circumferentially thereof, and a detector placed in the vicinity of the rotational body for detecting the circumferential edge portions of the detectable portion and for producing an electric signal containing amplitude variations appearing at the passage of the edge portions near the detector. The electric signal is processed by an ignition pulse generator which produces an ignition pulse at each time when a selected one of the amplitude variations of the electric signal occurs. The circumferential length of the detectable portion is selected so that the ignition pulse appears when the crank angle of the crank shaft is outside of the reverse rotation allowing angular region.

6 Claims, 13 Drawing Figures

IGNITION SYSTEM FOR TWO-CYCLE ENGINE

BACKGROUND OF THE INVENTION

1. Field of the Invention

The present invention relates to an ignition system for a two-cycle engine.

2. Description of the Prior Art

Various ignition systems for a two-cycle engine have been developed which can prevent the so-called reverse operation of the two-cycle engine, that is, the reverse rotation of the crank shaft of the engine. The ignition system usually includes an electric signal generator for producing an electric signal containing amplitude variations each appearing at a certain crank angle, that is, an angular position of the crank shaft, and an ignition pulse generator for generating an ignition pulse in response to each of the amplitude variations of the electric signal. As is well known, the electric signal generator includes a transducer positioned in the proximity of a rotational body or member rotatable in synchronism with the crank shaft. The transducer produces the electric signal in accordance with the mechanical position of the rotational body. Since, however, the transducer per se cannot distinguish the direction of the rotation of the crank shaft or the rotational body, the ignition pulse generator should be adapted to avoid producing an ignition pulse at such an ignition timing as to allow the reverse operation of the engine.

In a prior art ignition system, a so-called pulser coil is incorporated in an electric generator, or a dynamo, as the transducer. The pulser coil is positioned in the proximity of the rotor of the electric generator and is responsive to the variation of the magnetic field generated by the rotational movement of the rotor so as to produce the electric signal containing amplitude variations representative of the variation of the magnetic field. Thus, the electric signal has an electric phase corresponding to the mechanical angular position of the crank shaft, that is, the crank angle. When, therefore, the ignition timing is selected to be a small crank angle, at which the electric signal has a small amplitude, the ignition pulse generator is subject to erroneous operation due to external noises. When, on the other hand, the ignition timing is selected to be a large crank angle at which the electric signal has a large amplitude, the ignition timing at the reverse rotation of the crank shaft is within a reverse operation allowing an angular region in which the engine is allowed to operate in the reverse direction. When it is desired to avoid the reverse operation of the engine, the ignition pulse generator must distinguish the direction of the rotion of the crank shaft by means of another sensor for detecting the rotational direction of the crank shaft, with the result that the overall construction of the ignition system becomes large and complicated and accordingly costly.

SUMMARY OF THE INVENTION

Therefore, it is a primary object of the present invention to provide an improved ignition system which can avoid the reverse operation of the engine and is simple in construction.

It is another object of the present invention to provide an ignition system which is economical.

According to the present invention, there is provided an ignition system for a two-cycle engine which comprises: a rotational body rotatable in synchronism with the crank shaft of the engine and having a detectable portion extending circumferentially on the radially outer periphery thereof; a detector placed at a predetermined angular position of the rotational axis of the crank shaft and in the proximity of the outer periphery of the rotational body, for detecting both edges of the detectable portion and for producing an electric signal having two amplitude variations corresponding to both edges, the two amplitude variations being reverse in polarity to each other; and an ignition pulse producing circuit connected to the detector, for producing an ignition pulse in response to selected one polarity of the two amplitude variations of the electric signal, the length of the detectable portion being so selected that the ignition pulse is produced when the crank angle of the crank shaft is outside of the reverse rotation allowing angular region.

BRIEF DESCRIPTION OF THE DRAWINGS

The above-mentioned object and advantages of the invention will become apparent from the following description taken in conjunction with the accompanying drawings, in which.

DETAILED DESCRIPTION OF THE PRIOR ART

Figure 1:
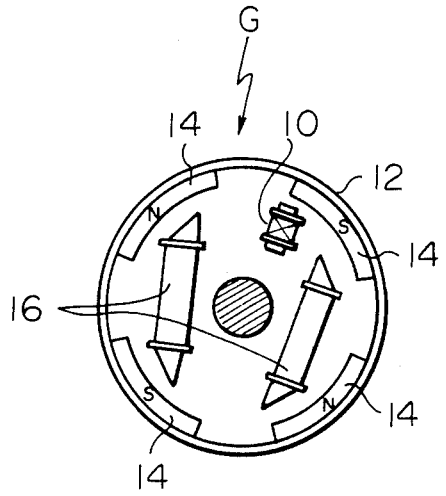
Fig. 1 PRIOR ART
FIG. 1 is a sectional view of a prior art transducer incorporated in an electric generator rotatable with a crank shaft of a two-cycle engine.

Referring now to FIG. 1, there is shown a prior art transducer usable for an ignition system which includes a pulser coil 10 positioned in the proximity of a flywheel type rotor 12 of an electric generator G adapted to be rotatable with the crank shaft (not shown) of a two-cycle engine. The rotor 12 carries thereon a plurality of magnets 14. A pair of stator coils 16 are placed within the rotor 12, which produces electric power in accordance with the rotational movement of the rotor 12. The pulser coil 10 produces an electric signal in response to variations of a magnetic field formed to pass therethrough by the rotor magnets 14. The electric signal produced from the pulser coil 10 has such a waveform as shown in a solid line in FIG. 2 during the normal direction of rotation of the crank shaft. However, the waveform of the electric signal has such a waveform as shown in a broken line in FIG. 1, at the reverse rotation of the crank shaft, which is inverse in phase to that of the electric signal at the normal rotation of the crank shaft.

Figure 2:
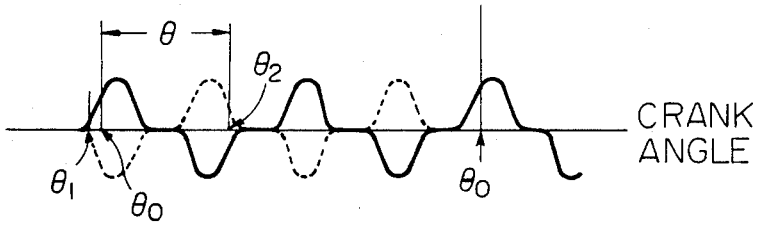
Fig. 2 PRIOR ART
FIG. 2 is a graph showing waveforms of an electric signal produced from the transducer of FIG. 1 in terms of the crank angle.

In FIG. 2, the angle $\theta_0$ represents a crank angle corresponding to TDC (Top Dead Center) and the angle $\theta_1$ represents the ignition timing at the normal operation of the engine. With this arrangement, the ignition timing at the reverse operation of the engine takes such an angular position as shown by $\theta_2$ which is apart from the angular position $\theta_0$ by an angle $\theta$ of about 100° and is outside of the reverse rotation allowing region. However, the electric signal has a small amplitude at the ignition angle $\theta_1$ as seen from FIG. 2 so that the ignition pulse generating circuit (not shown) is subject to erroneous operation due to external noises. Therefore, it is desired to select the ignition timing at a crank angle when the electric signal takes a large amplitude so as to avoid erroneous operation due to the external noises. In such arrangement, however, the ignition timing at the reverse operation of the engine locates within the reverse operation allowing region, as already mentioned above.

DETAILED DESCRIPTION OF THE EMBODIMENTS

Figure 3:
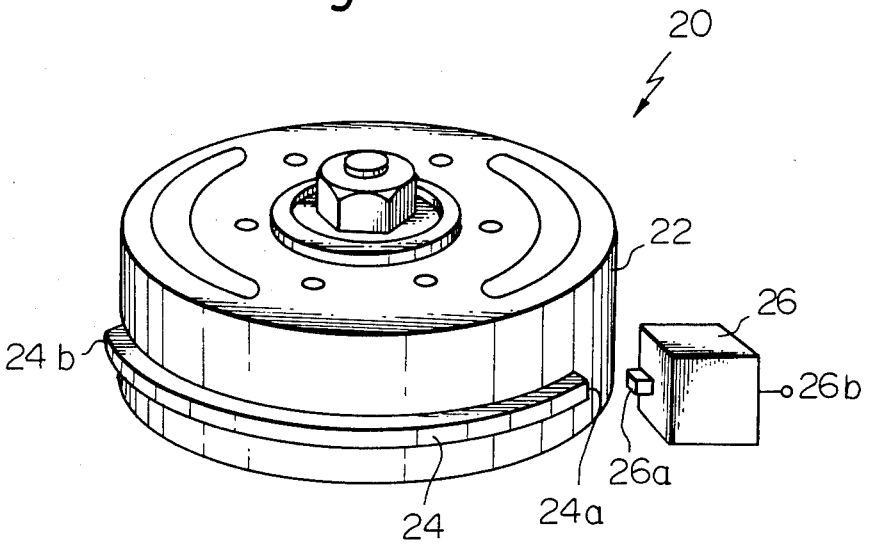
FIG. 3 is a perspective view showing a transducer assembly to be incorporated in an ignition system according to the present invention.
Figure 4:
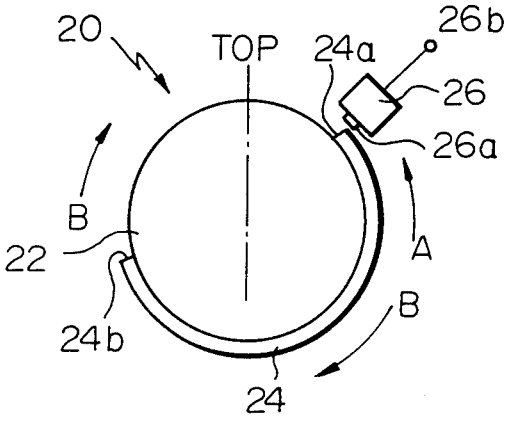
FIG. 4 is a diagram showing a dimensional relation between elements constituting the transducer assembly shown in FIG. 3.

Referring now to FIGS. 3 and 4, there is shown a transducer assembly 20 which is used in an ignition system according to the present invention. The tranducer assembly 20 includes a rotational body 22 connected to the crank shaft (not shown) of a two-cycle engine so that the rotational body 22 rotates in synchronism with the crank shaft. The rotational body 22 carries on the radially outer periphery thereof an inductive element 24 which is made of a magnetic member and extends circumferentially of the rotational body 22. The rotational body 22 may be such a rotor of an electric generator as the rotor 12 shown in FIG. 1. A magnetic sensor 26 is placed in the proximity of the rotational body 22 and has a magnetic pole 26*a* adapted to confront the inductive element 24 upon rotation of the rotational body 22 repeatedly. The magnetic sensor 26 further includes a pulser coil (not shown) which magnetically engages with a magnet having the magnetic pole 26*a* and has an output terminal 26*b*, so that an electric signal is produced from the output terminal 26*b* in concurrence with the rotation of the rotational body 22. Since the magnetic field linking the pulser coil varies at leading and trailing edge portions 24*a* and 24*b* of the inductive element 24, the electric signal produced from the output terminal 26*b* has amplitude variations appearing when the edge portions 24*a* and 24*b* passes before the magnetic pole 26*a* of the magnetic sensor 26.

Figure 5A:
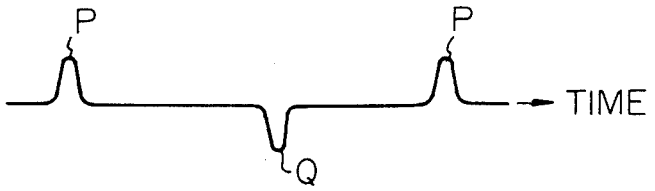
FIGS. 5A and 5B are diagrams respectively showing waveforms of electric signals obtained from the transducer assembly of FIG. 3 at the normal and reverse operations of the engine.
Figure 5B:
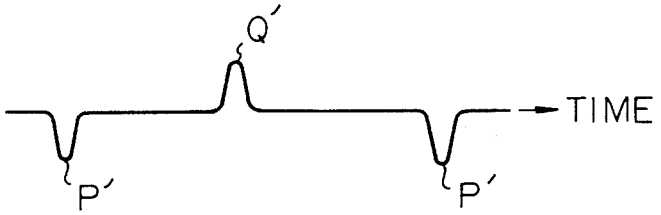

FIGS. 5A and 5B illustrate waveforms of the electric signal produced from the magnetic sensor 26 in the case of the normal rotational direction A of the crank shaft and the reverse rotational direction B, respectively. In FIG. 5A, amplitude variations P correspond to the edge or end portion 24*a* and the amplitude variation Q corresponds to the end portion 24*b*. In FIG. 5B, amplitude variations P' and Q' respectively correspond to the end portions 24*a* and 24*b*.

Figure 6:
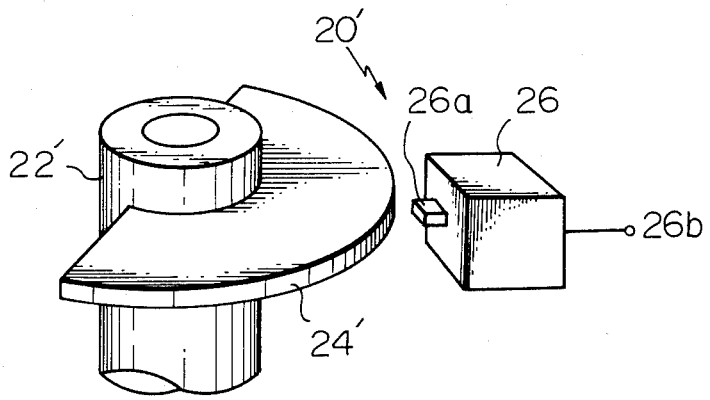
FIG. 6 is a perspective view showing another transducer assembly to be used for the ignition system according to the present invention.

In FIG. 6, there is shown another example of a tranducer assembly 22' according to the present invention which has the same construction as that of FIGS. 3 and 4 except that an inductive element 24' of a generally semicircular shape is mounted on a rotational body 22' which is rotatable together with the rotor of an electric generator connected (not shown) to the crank shaft.

Figure 7:
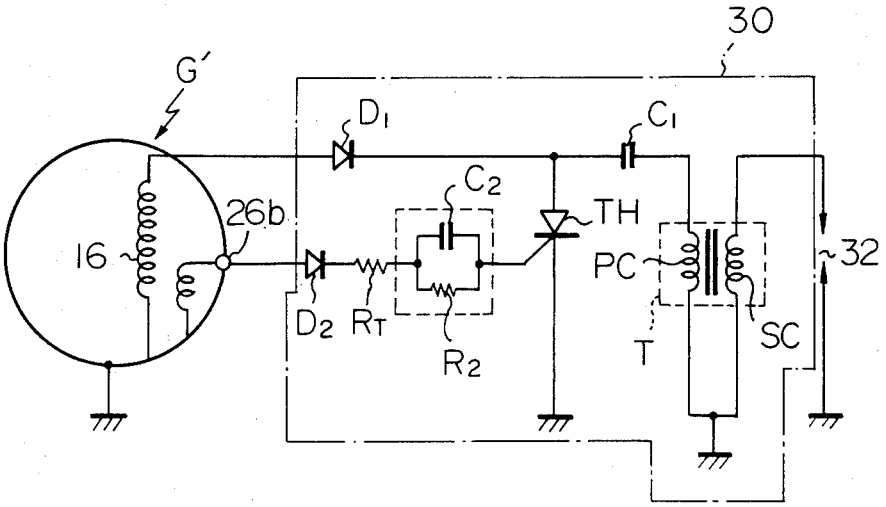
FIG. 7 is a circuit diagram showing an overall ignition system according to the present invention in which the transducer assembly shown in FIG. 3 or 6 is incorporated.

In FIG. 7, an ignition pulse generator 30 of so-called CDI (Charge-Discharge Ignition) type is shown which is connected to an electric generator G' having a similar construction as the electric generator G of FIG. 1. However, the generator G' is equipped with such a transducer assembly as shown in FIG. 3 or 4 according to the present invention. The ignition pulse generator 30 includes a diode $D_1$ through which the electric voltage from the stator coil 16 is supplied to a charging capacitor $C_1$ and the capacitor $C_1$ is charged up by a current flowing through the diode $D_1$, the capacitor $C_1$ and a primary coil PC of a transformer T. The electric signal produced from the output terminal 26*b* of the transducer assembly is supplied through a trigger circuit constituded by a diode $D_2$, resistors $R_T$ and $R_2$, and a capacitor $C_2$ to a gate terminal of a gate-controlled rectifier TH such as a thyristor. The gate-controlled rectifier TH has its anode terminal connected to the anode of the diode $D_1$ and its cathode terminal grounded. A secondary coil SC of the transformer T is connected to an ignitor 32 which is provided within a cylinder (not shown) of a two-cycle engine.

With the above-mentioned arrangement, the ignition pulse generator 30 repeatedly supplies ignition pulses to the ignitor 32 in response to positive spike pulses from the output terminal 26*b* such as those pulses P and Q' shown in FIGS. 5A and 5B.

Figure 8:
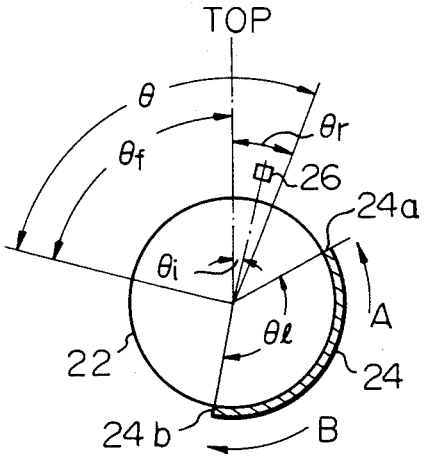
FIGS. 8 through 10 are diagrams showing dimensional relation between elements of the transducer assembly shown in FIG. 3 or 6.

Referring now to FIG. 8, there will be discussed a dimensional relation between the transducer assembly according to the present invention and the crank shaft. In this figure, a reference angular position TOP with respect to the rotational axis of the crank shaft, i.e. the rotational body 22 represents a crank angle of zero at which the piston takes the so-called TDC (Top Dead Center). It is well known in the art that the so-called reverse operation allowing region of the ignition timing can be shown by an angular region $\theta$ when the reverse rotation B of the crank shaft is clockwise. The reverse operation allowing region $\theta$ constituted by a BTDC region $\theta_f$ and a ABTC region $\theta_r$. As seen from this figure, the BTDC region $\theta_f$ is much wider than the AJDC region $\theta_r$. On the other hand, the length of the inductive element 24 is indicated by an angle $\theta_l$.

When it is assumed that the longitudinal direction of the crank arm aligns with a radial direction of the rotational body 22 passing through the leading edge 24*a*, the magnetic sensor 26 is positioned at the angular position $-\theta_i$ measured from the reference angular position TOP in the normal rotational direction A so as to obtain an ignition timing of $-\theta_i$ since such a positive pulse P as shown in FIG. 5A appears at the output terminal 26*b* at each passage of the edge 24*a* before the magnetic sensor 26.

Figure 9:
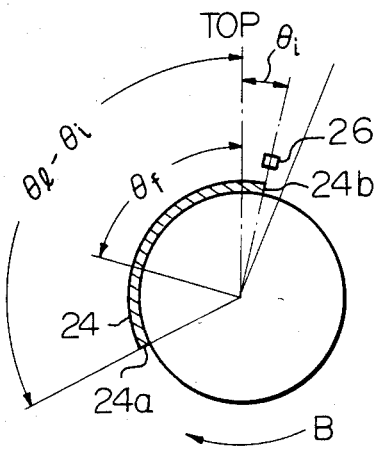

When, with the above-mentioned arrangement, the reverse rotation B of the crank shaft takes place, such a positive pulse Q' as shown in FIG. 5B is produced from the magnetic sensor 26 upon passage of the trailing edge 24*b* before the magnetic sensor 26 as shown in FIG. 9. At this moment, the edge 24*a*, that is the longitudinal direction of the crank arm takes an angular position $-(\theta_l-\theta_i)$, so that the ignition timing for the reverse rotation is represented by $-(\theta_l-\theta_i)$. It is now to be understood that the ignition timing for the reverse rotation of the crank shaft is to be outside of the reverse rotation allowing region in order to avoid the reverse rotation of the crank shaft that is, the reverse operation of the engine and therefore, the length of the inductive element 24 should be selected so as to suffice a relation: $(\theta_l-\theta_i)>\theta_f$ as clearly seen from FIG. 9. As is well known in the art the angle $\theta_f$ is usually about 80° and $\theta_i$ is usually 10°, and the angle $\theta_l$ should be larger than about 90°. Thus, the inductive element 24 should have a relatively long length.

It is, however, to be understood that the magnetic sensor 26 and the ignition pulse generator 30 may be modified so that the ignition pulse is generated upon the passage of the trailing edge 24*b* before the magnetic sensor 26 under the normal rotation A. In this embodiment, the longitudinal direction of the crank arm is to be aligned with a radial direction passing through the trailing edge 24*b*.

Figure 10:
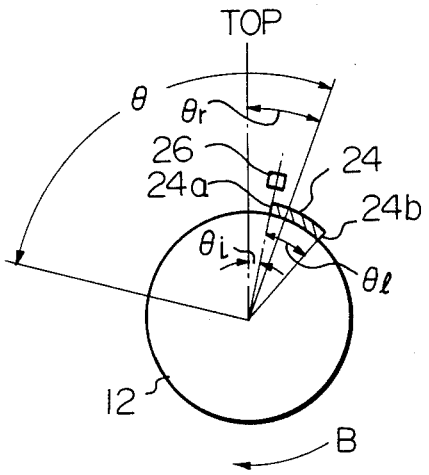

When, with this arrangement, the crank shaft rotates in the reverse direction B, the ignition pulse is generated at the passage of the leading edge 24*a* before the magnetic sensor 26 as shown in FIG. 10. Thus, the ignition timing for the reverse rotation is $(\theta_i+\theta_l)$, as seen from FIG. 10. In this specific arrangement, a relation:- $\theta_i+\theta_l>\theta_r$ is sufficient for avoiding the reverse rotation of the crank shaft. As is well known in the art the angle $\theta_r$ is usually about 20°, the angle $\theta_l$ should be larger than merely about 10°.

It is now apparent from the above description that the length of the inductive element 24 can be reduced by such an arrangement that the ignition pulse at the normal rotation of the crank shaft is produced upon passage of the trailing edge 24*b* of the inductive element at the normal operation. This is because the ignition timing for the reverse rotation is, in this arrangement, advanced by the angle $\theta_l$ from the ignition timing corresponding to the angular position $\theta_i$ and the ATDC region $\theta_r$ is narrower than the BTDC region $\theta_f$.

Figure 11A:
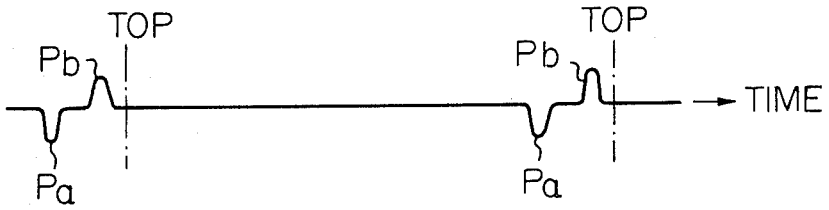
FIGS. 11A and 11B are diagrams respectively showing waveforms of electric signals obtained from a transducer modified from that of FIG. 3 which produces electric signals as shown in FIGS. 5A and 5B.
Figure 11B:
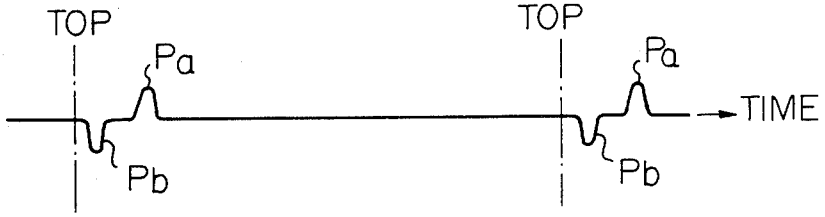

When the magnetic sensor 26 is so arranged as to produce an electric signal having such a waveform as shown in FIG. 11A wherein the electric signal contains consecutive negative and positive peaks Pa and Pb respectively corresponding to the leading and trailing edges 24*a* and 24*b* of the inductive element 24, no modification will be required in the ignition pulse generator 30 of FIG. 7 so as to obtain such an ignition system as mentioned above with reference to FIG. 10 wherein the ignition pulse is produced upon passage of the trailing edge 24*b* of the inductive element 24 before the magnetic sensor 26 at the normal operation of the engine. In this case, the electric signal from the magnetic sensor 26 has such a waveform as shown in FIG. 11B at the reverse operation of the engine.

Although a magnetic sensor 26 is used for the purpose of detection of the angular position of the crank shaft in the above-mentioned embodiments, another type of detector such as a photo-coupler, a mechnical switch etc. may be used in substitution for the magnetic sensor 26, if preferred. In such case, the inductive element 24 need not be magnetic.

It will be understood that the invention is not to be limited to the exact construction shown and described and that various changed and modifications may be made without, departing from the spirit and scope of the invention, as defined in the appended claims.

What is claimed is:

1. An ignition system for a two-cycle engine, which comprises:

a rotational body rotatable in synchronism with the crank shaft of said engine in normal and reverse directions and having a detectable portion including a leading edge and a trailing edge and extending circumferentially on the radially outer periphery thereof;

a detector placed at a predetermined angular position with respect to the rotational axis of said crank shaft and in the proximity of the outer periphery of said rotational body, for detecting both edges of said detectable portion and for producing an electric signal having two amplitude variations corresponding to said both edges, said two amplitude variations being reverse in polarity to each other: and an ignition pulse producing circuit connected to said detector for producing an ignition pulse in response to selected one polarity of said two amplitude variations of said electric signal, the angular position of said detector with respect to said crank shaft and the circumferential length $(\theta_l)$ of said detectable portion being so selected that said crank shaft is positioned at a crank angle which is outside of the reverse rotation allowing angular region constituted by before top dead center (BTDC) and after top dead center (ATDC) regions $(\theta_f, \theta_r)$ during reverse rotation of said crank shaft;

said detector being adapted to produce said selected one polarity of the amplitude variation when it detects the trailing edge of the detectable portion under the rotation of the crank shaft in both directions, so that the ignition angle at the reverse rotation of the crank shaft is equal to and angle of $(\theta_l+\theta_i)$, where the angle $\theta_i$ is an ignition angle at the normal rotation of said crank shaft and the angle of $(\theta_l+\theta_i)$ is so determined to be larger than the angle of $\theta_r$ to avoid reverse rotation of the crank shaft.

2. An ignition system according to claim 1, in which said detectable portion is made of a magnetic member and said detector is a magnetic sensor for producing an electric signal in response to variations in the magnetic field passing therethrough.

3. An ignition system according to claim 2, in which said rotational body is made of a magnetic member, and said detectable portion is a projection mounted on the periphery of said rotational body.

4. An ignition system according to claim 1, wherein said leading edge of said detectable portion causes the detector to produce a pulse of a nonselected, negative polarity during normal rotation of the crank shaft.

5. An ignition system according to claim 1, wherein the trailing edge of said detectable portion is detected by said detector for producing the ignition timing pulse in the ignition system during normal and reverse rotation of said crank shaft.

6. An ignition system according to claim 1, wherein the length of the detectable portion extending on the periphery of said rotational body is defined as an arc of an angle of approximately 10°.

* * * * *